US010589950B2

(12) United States Patent
Irizarry et al.

(10) Patent No.: US 10,589,950 B2
(45) Date of Patent: Mar. 17, 2020

(54) GRAVITY-ASSISTED WALL REGISTRATION SYSTEM

(71) Applicant: Xerox Corporation, Norwalk, CT (US)

(72) Inventors: Roberto A. Irizarry, Rochester, NY (US); Carlos M. Terrero, Ontario, NY (US); Jeffrey N. Swing, Rochester, NY (US); Michael J. Linder, Walworth, NY (US); Elizabeth M. Crossen, Churchville, NY (US); Ron E. Dufort, Rochester, NY (US); Dara N. Lubin, Pittsford, NY (US); Daniel M. McHugh, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/939,907

(22) Filed: Mar. 29, 2018

(65) Prior Publication Data

US 2019/0300314 A1 Oct. 3, 2019

(51) Int. Cl.

| | |
|---|---|
| ***B65H 9/16*** | (2006.01) |
| ***B65H 5/06*** | (2006.01) |
| ***B65H 9/20*** | (2006.01) |

(52) U.S. Cl.

CPC ..... *B65H 9/16* (2013.01); *B65H 5/062* (2013.01); *B65H 9/20* (2013.01); *B65H 2301/441* (2013.01); *B65H 2405/1115* (2013.01)

(58) Field of Classification Search

CPC .... B65H 9/16; B65H 9/166; B65H 2511/214; B65H 2405/1115; B65H 2301/324; B65H 5/008; B65H 2301/441

See application file for complete search history.

(56) References Cited

U.S. PATENT DOCUMENTS

| | | | | |
|---|---|---|---|---|
| 4,179,117 A | | 12/1979 | Rhodes, Jr. | |
| 4,775,142 A | | 10/1988 | Silverberg | |
| 5,031,894 A | * | 7/1991 | Bedzyk | B65H 5/38 271/240 |
| 5,065,998 A | * | 11/1991 | Salomon | B65H 9/166 198/456 |
| 7,735,818 B2 | * | 6/2010 | Fournier | B65H 1/06 271/165 |

(Continued)

FOREIGN PATENT DOCUMENTS

JP 56122747 A * 9/1981 ..... B65H 5/068

*Primary Examiner* — Patrick Cicchino

(74) *Attorney, Agent, or Firm* — Fay Sharpe LLP

(57) ABSTRACT

A gravity-assisted registration system suited to use in a printing device includes a transport member with a surface on which an associated sheet is translated in a process direction. The surface defines an angle with respect to horizontal in a cross-process direction. A registration wall, adjacent a lower end of the surface, defines a registration edge for registering the sheet. A drive mechanism drives at least one rotation mechanism, for translating sheet in the process direction, each rotation mechanism including at least one drive member with an axis of rotation parallel to the surface in the cross-process direction, Each drive member includes a sliding mechanism, at a periphery of the drive member, enabling the sheet to slide, under gravity, on the surface, toward the registration wall into an alignment position, in contact with the registration wall.

19 Claims, 11 Drawing Sheets

(56) References Cited

U.S. PATENT DOCUMENTS

| | | | | |
|---|---|---|---|---|
| 7,828,286 | B2 * | 11/2010 | Dekoning | B65H 29/52 271/184 |
| 2008/0179826 | A1 * | 7/2008 | Gregoire | B65G 13/10 271/264 |
| 2015/0217958 | A1 | 8/2015 | Dunham et al. | |
| 2015/0284203 | A1 | 10/2015 | Terrero et al. | |
| 2018/0218557 | A1 * | 8/2018 | Cao | G07F 19/20 |

* cited by examiner

GRAVITY-ASSISTED WALL REGISTRATION SYSTEM

BACKGROUND

The exemplary embodiment relates generally to sheet transport systems and finds particular application in connection with a gravity-assisted registration system for sheet media which is suited to use in a printing system.

Transport systems are widely used for transporting sheet media between and within modules of a printing system, such as between a sheet feeder and a marking module, or on a return path through the marking module to enable duplex (double sided) printing. The transport system may include a combination of rollers, conveyor belts, vacuum-assisted transport units, and the like. In order to ensure that each sheet arrives at a printer component with an acceptable level of skew and lateral errors, registration subsystems are used to steer the sheets to achieve correct alignment.

There are demands for new printer designs that are able to increase the size of the sheet (e.g., to about 66 cm, or higher, in process-direction length) or to increase the printer speed from what is conventionally achievable. For the registration subsystem, steering long sheets and steering sheets at high speeds are challenging. In high speed printers, the amount of time available to perform the registration correction is reduced, which can increase stresses on the sheets. This means that sheets may not be correctly registered if their input error is too large. Registration correction algorithms are used to attempt to steer these sheets to the machine registration targets. However, the large corrections may result in sheet trailing edges being driven into the sidewalls of the transport (resulting in sheet damage or jams) or cause sheets to slip, breaking free of the drive nips, resulting in poor registration.

In one type of registration subsystem, skew and lateral errors are corrected in one motion. This correction induces more skew to move the sheet laterally, creating a 'tail-wag' motion of the sheet. This motion of the sheet is stressful, and the tangential forces on the sheet may exceed the threshold of slip with larger sheets. Another type of registration subsystem uses independent drive rolls for correcting skew while lateral correction is effected by a translating (cross-process) carriage. This has an advantage of decoupling the lateral and skew correction. However, the use of the translating carriage limits the maximum speed of the printer system due to the limit on the carriage return time that can be achieved, given the mass of the carriage (including motors, rollers and other drive elements).

One method used to enable registering large sheets is to manually adjust the positions of preceding modules to try to keep the input error low. For example, the sheet feeder may undergo an alignment procedure to reduce the errors in the sheet entering the marking module, or a duplex path alignment procedure may be performed. However, such module alignment procedures impact only the mean input error and are unable to address sheet-to-sheet variations. Thus, even though average input error may be within acceptable bounds, sheet-to-sheet variations can result in misregistration of some of the sheets.

There remains a need for systems and methods for media registration which address these deficiencies and enable improvements in the capability of a printing system to handle faster sheet speeds, larger sheet sizes, and/or larger weight sheets.

INCORPORATION BY REFERENCE

The following references, the disclosures of which are incorporated in their entireties by reference, are mentioned:

U.S. Pub. No. 20150284203, published Oct. 8, 2015, entitled FINISHER REGISTRATION SYSTEM USING OMNIDIRECTIONAL SCUFFER WHEELS, by Terrero, et al., describes a sheet registration system for use in a finisher of a digital printing system. Omnidirectional scuffer wheels with a plurality of overlapping rollers provide uninterrupted traction to move media sheets against a registration wall for process direction registration.

U.S. Pub. No. 20150217958, published Aug. 6, 2015, entitled SYSTEMS AND METHODS FOR IMPLEMENTING UNIQUE OFFSETTING STACKER REGISTRATION USING OMNI-DIRECTIONAL WHEELS FOR SET COMPILING IN IMAGE FORMING DEVICES, by Dunham, et al., describes a system for improving stack integrity for a set of image receiving media substrates at an output of a compiler in an image forming device. A substrate handling device downstream of the output of the compiler includes a plurality of omni-directional wheeled devices that provide drive (traction) normal to a motor axis under control of one of a respective plurality of independent motors while allowing sliding in the motor axis direction. When using three or more omni-directional wheeled devices, translational movement can be combined with rotation to deliver sheets of image receiving media exiting the compiler at a correct angle and lateral position for further processing.

U.S. Pat. No. 4,775,142, issued Oct. 4, 1988, entitled ROLLER APPARATUS FOR SIDE REGISTRATION OF DOCUMENTS, by Silverberg, describes an apparatus for urging documents against a registration fence while simultaneously driving the documents along a conveying path determined by the fence.

U.S. Pat. No. 5,065,998, issued Nov. 19, 1991, entitled LATERAL SHEET REGISTRATION SYSTEM, by Salomon, describes a sheet registration and feeding system for laterally registering a sheet without frictional drive slippage against the sheet.

U.S. Pat. No. 4,179,117, issued Dec. 18, 1979, entitled PAPER ALIGNMENT ROLLERS, by Rhodes, Jr., describes paper aligning rolls in which the drive roll is skewed to the direction of travel move paper toward a referencing edge while the backup roll is oppositely skewed to urge the paper away from the referencing edge.

BRIEF DESCRIPTION

In accordance with one aspect of the exemplary embodiment, a gravity-assisted wall registration system includes a transport member including a surface on which an associated sheet is translated in a process direction. The surface defines an angle with respect to horizontal in a cross-process direction of at least one degree. A registration wall adjacent a lower end of the surface defines a registration edge for registering the sheet. The system further includes a drive mechanism and at least one rotation mechanism, driven by the drive mechanism, for translating sheet in the process direction. Each rotation mechanism includes at least one drive member with an axis of rotation parallel to the surface in the cross-process direction. Each drive member includes a sliding mechanism, at a periphery of the drive member, which enables the sheet to slide, under gravity, on the surface, toward the registration wall into an alignment position, in contact with the registration wall.

In accordance with another aspect of the exemplary embodiment, a printing system includes a marking device, which applies a marking material to associated sheets of print media, and a sheet transport system, which transports the sheets in a process direction to the marking device. The sheet transport system includes a gravity-assisted registration system. The gravity-assisted registration system includes a transport member including a surface on which the sheets are translated in the process direction. The surface defines an angle with respect to horizontal in a cross-process direction of at least 1 degree. A registration wall adjacent a lower end of the surface defines a registration edge for registering the sheet. The gravity-assisted registration system further includes a drive mechanism and at least one rotation mechanism, driven by the drive mechanism. Each rotation mechanism includes at least one drive member with an axis of rotation parallel to the surface in the cross-process direction, which translates the sheets in the process direction. Each drive member includes a sliding mechanism, at a periphery of the drive member, enabling the sheets to slide, under gravity, on the surface, toward the registration wall into an alignment position, in contact with the registration wall.

In accordance with another aspect of the exemplary embodiment, a method of printing includes transporting a sheet of print media in a process direction on a print media path. The sheet of print media is registered with a gravity-assisted registration system to reduce at least one of skew and lateral shift. A marking material is applied to the sheet with a marking device positioned on the paper path, upstream or downstream of the gravity-assisted registration system. The gravity-assisted registration system includes a transport member including a surface on which the sheet is translated in the process direction, the surface defining an angle with respect to horizontal in a cross-process direction, of at least 1 degree. A registration wall, adjacent a lower end of the surface, defines a registration edge for registering the sheet. The gravity-assisted registration system further includes a drive mechanism and at least one rotation mechanism, driven by the drive mechanism. Each rotation mechanism includes at least one drive member with an axis of rotation parallel to the surface in the cross-process direction, which translates the sheet in the process direction, each drive member including a sliding mechanism, at a periphery of the drive member, enabling the sheet to slide, under gravity, on the surface, toward the registration wall into an alignment position, in contact with the registration wall.

DETAILED DESCRIPTION

Aspects of the exemplary embodiment relate to a gravity-assisted wall registration system suited to use in a printer for correcting or reducing registration errors in sheets of print media as they are conveyed along a paper path. The wall registration system allows each sheet to be registered independently and quickly and is particularly suited to use in high speed printers and/or those which are designed to handle large sheets of print media. In particularly, rotatable members are used to apply a driving force to a sheet in the process direction, while a sliding mechanism allows the sheet to slide, under gravity, towards a registration wall.

As used herein, a "printer," or a "printing system" refers to one or more devices used to generate printed media by forming images on print media, using a marking material, such as one or more colored inks or toner particles. The printer may be a digital copier, bookmaking machine, facsimile machine, multi-function machine, or the like, which performs a print outputting function. The print media may be sheets of paper, card, transparencies, parchment, film, fabric, plastic, photo-finishing papers, or other coated or non-coated flexible substrates suitable for printing.

The printer includes a marking module which may incorporate one or more xerographic marking devices in which toner particles are transferred from an electrically charged surface to the print media and then fused to the sheet. Alternatively, the printer may be inkjet printer which incorporates an inkjet marking device including inkjet heads which jet droplets of ink onto the print media, which are then cured, e.g., with ultraviolet radiation. Other marking devices are also contemplated. The printer may be configured for monochrome (single color) and/or color (more than one color) printing.

The "leading edge" of a sheet of print media refers to an edge of the sheet that is furthest downstream in the process direction. The "process direction" refers to the direction in which a sheet travels along a paper path during the printing process.

While some components of the printer are described herein as modules, this is not intended to imply that they are separately housed from each other and in some embodiments, may be otherwise separated into different housings or contained in a single printer housing.

Figure 1:
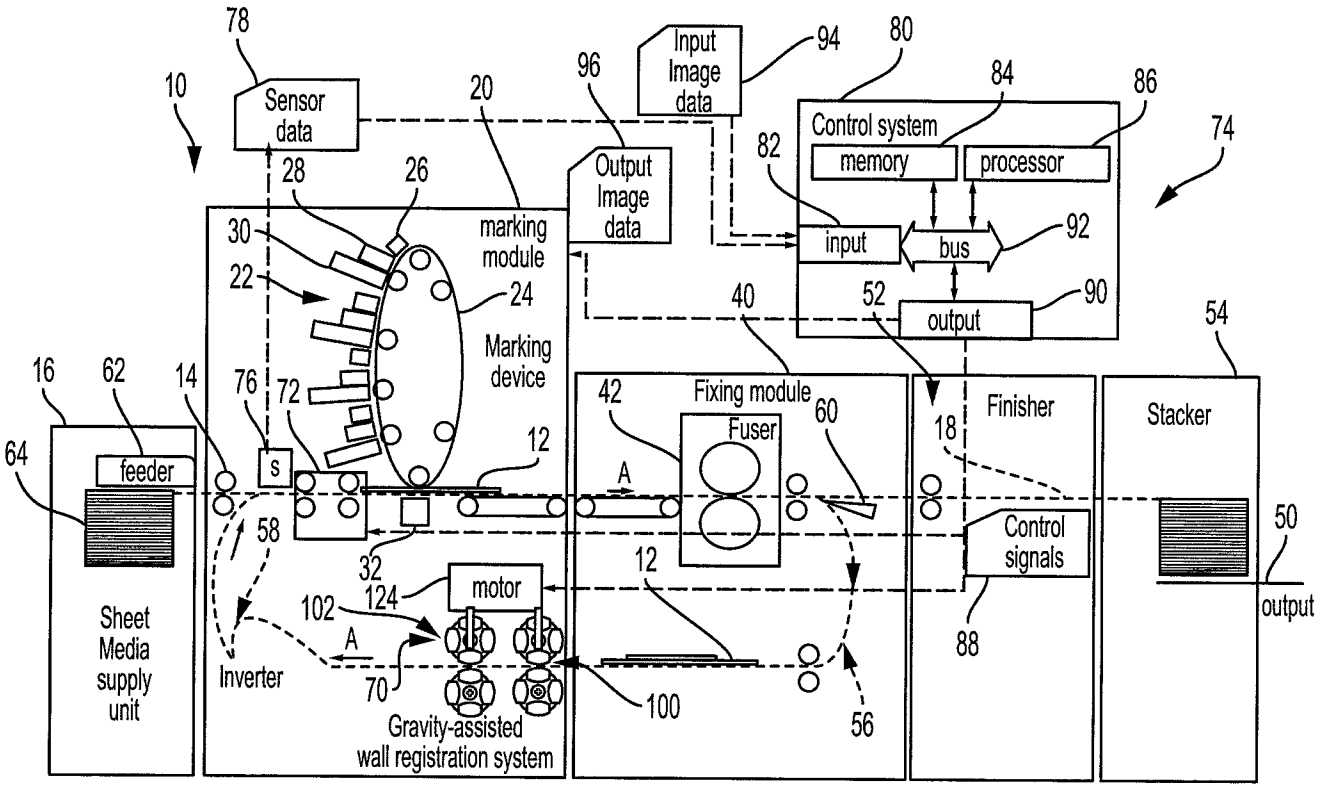
FIG. 1 is a schematic side sectional view of a printer incorporating a gravity-assisted wall registration system in accordance with one aspect of the exemplary embodiment.

FIG. 1 is a schematic illustration of an exemplary printer 10. The printer is configured for forming images on sheets 12 of print media, such as paper, using a marking material, such as inks or toners. The printer 10 may be a xerographic printer, as illustrated, an inkjet printer, combination thereof, or the like. A sheet transport system 14 conveys sheets to be printed from a sheet media supply unit 16 along a paper path 18 in the downstream (process) direction, illustrated by arrow A, to a marking module 20 where the marking material is applied to the sheets 12 by a suitable marking device 22. In the case of a xerographic printer, the marking device may include a photoconductive surface 24, such as a belt or drum, which is charged at one or more charging stations 26 (four in the illustrated embodiment), exposed at a respective exposure station 28 to form a latent image, and developed at a developer station 30, by attracting charged toner particles to the latent image, thereby forming an image on the photoconductive surface 24. The image is transferred to the passing sheet 12 at a transfer station 32. As will be appreciated, in an inkjet printing system, an array of ejectors drop ink droplets onto the passing sheet.

Independent of the type of marking module 20, skew and/or lateral shift in the sheet as it passes through the print module can result in incorrect positioning of the image on the sheet.

From the marking module 20, the sheet transport system 14 conveys the printed sheets to a fixing module 40, where the marking material is more permanently affixed to the sheet. In a xerographic printer, fixing module 40 may include a fuser 42, which applies heat and pressure to the marked sheet. In the case of an inkjet printer the inks may be cured with heat and/or UV radiation.

From the fixing module 40, the sheet transport system 14 conveys the printed sheets to a sheet output 50, such as an output tray, where the marked sheets are output. The printer may include other components, such as a finisher 52 and/or stacker 54 in the paper path, intermediate the fixing module 40 and the output 50. The finisher performs post-processing operations, such as stapling, collating, binding, and the like, while the stacker assembles the sheets into a stack. In the illustrated printer, the paper path 18 includes a return loop 56, which returns the sheets to the marking device 22, e.g., via an inverter 58, to allow printing on the other side of the sheet. A diverter 60 may be used to divert the sheets into the return loop 56, when needed.

The transport system 14 may include various mechanisms for conveying the sheets, such as rollers, drive nips, belts, air/vacuum assisted transport mechanisms, and the like. In particular, a sheet feeder 62 draws sheets singly from a stack 64 in the supply unit 16 and sends them in single file along the paper path 18. The transport system 14 also includes one or more registration components for registering the sheets intermediate the sheet feeder 62 and the printed media output 50. At least one of the registration components is in the form of a gravity-assisted wall registration system 70, which repositions each sheet, as needed, to reduce skew and/or lateral shift (in the cross-process direction). In the illustrated printer 10, the registration system 70 is positioned in the return loop 56, to register the sheets before they return to the marking device 22. As will be appreciated, one or more registration systems 70 may be alternatively or additionally positioned elsewhere along the paper path 18, such as between the sheet feeder 62 and the marking device 22, and/or between the marking device and the fixing module 40. The wall registration system 70 may feed the sheets to a further registration system 72, upstream of the marking device.

The printer may include a feedback system 74 which includes one or more sensors 76, positioned in the paper path 18, e.g., upstream of one or more of the registration systems 70, 72. Suitable sensors include charge-coupled devices (CCD), contact image sensors (CIS), and similar sensor arrays. Each sensor is configured to acquire sensor data 78, relating to the skew and/or lateral shift of each sheet passing along that part of the paper path 18. The sensor data 78 is used to determine adjustments to the respective registration system 70, 72 if needed, for the particular sheet being registered. For example, the sensor data 78 is acquired from the sensor(s) by a control system 80. The control system includes an input device 82, which receives the sensor data into memory 84. Memory 84, or a separate memory, stores instructions, which are executed by an associated processor device 86, for generating control signals 88, which are output from the control system 80 via a data output device 90. Hardware components 82, 84, 86, 90 of the control system may be communicatively connected by a data/control bus 92. The control signals 88 are received by the respective registration system 70, 72. The respective registration system 70, 72 makes registration adjustments, based on the control signals 88, with the aim of reducing detected lateral shift and/or skew.

In one embodiment, the wall registration system 70 operates without sensor-derived feedback 88.

The control system may also control other components of the printer, such as the marking module 20, finishing module 40, finisher 52 and stacker 54. In one embodiment, the control system receives input image data 94 representing an image to be rendered, and includes instructions for converting the image data 94 into output image data 96 in a form which can be interpreted by the marking module 20.

Figure 2:
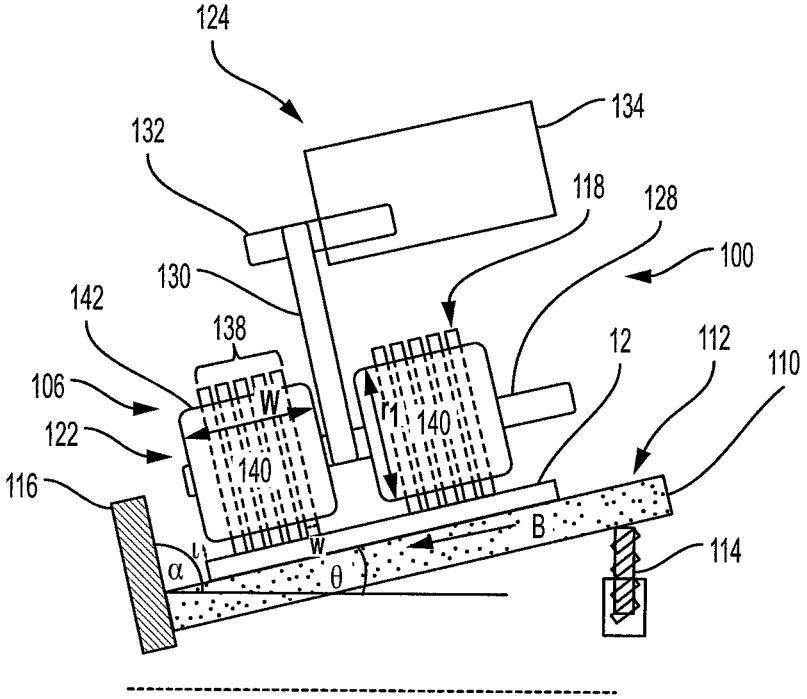
FIG. 2 is a side sectional view, in the process direction, of a first embodiment of a gravity-assisted wall registration system.
Figure 3:
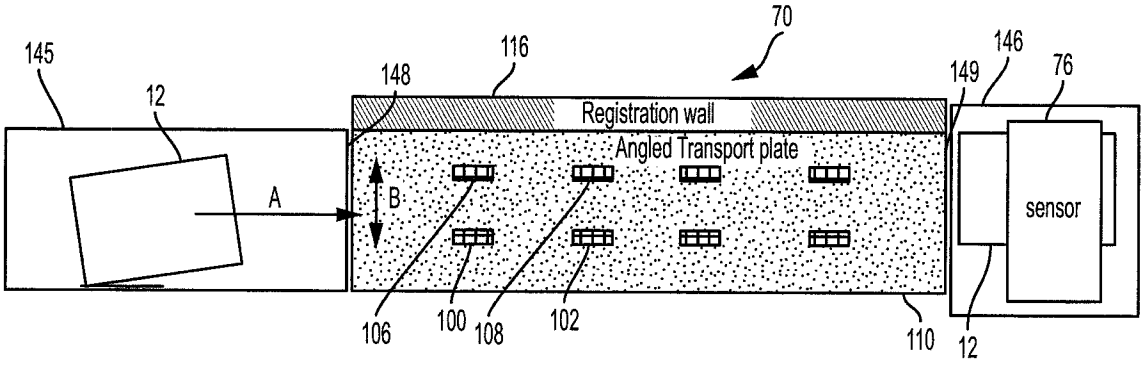
FIG. 3 is a top plan view of the wall registration system of FIG. 2.

The illustrated wall registration system 70 includes one or more rotation mechanisms 100, 102, 106, 108 (see also FIGS. 2-6). The wall registration system 70 includes at least one or at least two sets of rotation mechanisms (such as set 100, 106, and set 102, 108, etc.), each set including two or more rotation mechanisms. The rotation mechanisms in a set may be arranged in parallel with, and laterally spaced in, the cross-process direction and may be driven by a common drive mechanism. FIG. 3 illustrates eight rotation mechanisms, arranged in four pairs, although fewer or more rotation mechanisms may be employed. The rotation mechanisms each include one or more rollers/wheels (rotatable members) which are configured to enable sheets to shift laterally (in the cross-process direction), with the aid of gravity, into an alignment position, while causing the sheets to continue, substantially uninterrupted, in the process direction, illustrated by arrow A. Different embodiments of the rotation mechanisms 100, 102, 106, 108 are described in further detail below.

The gravity-assisted wall registration system 70 may be used for pre-registration to eliminate any large misalignment in the print media position prior to a finer scale registration by the second registration system 72. By eliminating any gross misalignment this makes it possible to utilize larger, heavier media that would traditionally be too difficult to align using conventional registration systems. The wall registration system 70 is able utilize the weight of heavier media to its advantage in aligning the media.

A transport member 110, such as a plate or continuous belt, has an upper surface 112, on which the sheet media 12 is transported by the rotation mechanisms. The member 110 may be formed of sheet metal or plastic. At least a portion of the upper surface 112, is angled to the horizontal, in the cross-process direction B, by an angle θ, as illustrated in FIG. 2. The angle θ of the transport member 110 may be at least 1 degree or at least 2 degrees, or at least 5 degrees or at least 8 degrees, or up to 90 degrees, or up to 45 degrees, or up to 30 degrees, or up to 20 degrees. In one embodiment, the angle θ may be adjustable, using a suitable adjustment mechanism 114, between minimum and maximum values, to accommodate a variety of media weights, e.g., adjustable between 1 and 45 degrees or between 5 and 20 degrees. The angle θ of the transport member need only be sufficient to overcome the friction forces between the sheet media 12 and the transport member 110. The angle may be reduced if a low friction material is used for the member 110.

A lower end of the transport member 110 terminates in a registration wall 116, which extends upward and may be angled generally perpendicular to the transport member 110.

The wall 116 provides a registration edge for the sheets. The registration wall 116 may be rigidly connected to the member 110, or spaced therefrom. The registration wall 116 provides a barrier to lateral movement of the sheet 12 in the cross-process direction when the sheet 12 makes contact with the registration wall 116. The sheet moves towards the registration wall at least partially under the influence of gravity.

Figure 4:
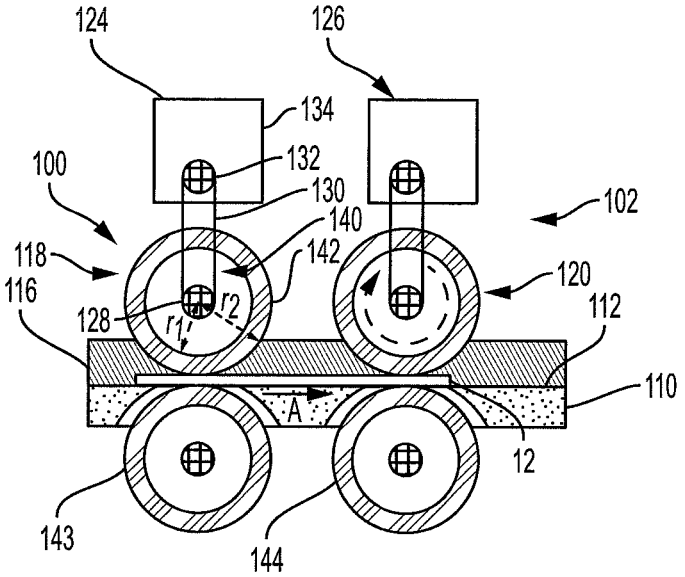
FIG. 4 is a side sectional view, in the cross-process direction, of the wall registration system of FIG. 2.

In a first embodiment, illustrated in FIGS. 2-4, each rotation mechanism 100, 102, 106, 108 includes a rotatable member 118, 120, 122, etc., such as a wheel or roller. At least some of the rotatable members 118, 120, 122, etc., are drive members which are driven (rotated) by a drive mechanism 124, 126, etc. For example, each wheel 118, 120, 122, etc. may be mounted on a shaft 128, which provides an axis of rotation which is aligned generally perpendicular to the process direction A. The shaft carries a drive belt 130 connected to a corresponding shaft 132 of a drive motor 134. In some embodiments, two or more rotatable members may be driven by a common drive mechanism 124, as illustrated in FIG. 2. In one embodiment, four or more, or all of the rotatable members on the same transport member 110 may be driven by a common drive mechanism 124. As will be appreciated a variety of drive mechanisms may be employed, such as a direct drive motor coupled to the shaft, or the like.

The exemplary drive mechanism 124, 126 remains in a fixed position, relative to the process and cross-process directions, during advancement of the sheet, i.e., there is no need to translate the rotation mechanism 100, 102, 106, 108 laterally, towards the wall 116, in order for registration to occur.

Figure 5:
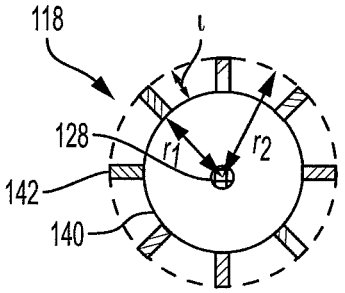
FIG. 5 is a cross-sectional view of a wheel of the wall registration system of FIG. 2 in accordance with another embodiment.

The drive members 118, 120, 122 each incorporate a sliding mechanism 138, which allows the sheet 12 to slide, under the force of gravity, towards the registration wall. In one embodiment, the drive members 118, 120, 122, etc., may be formed from rubber or other suitable material. As illustrated in FIGS. 2 and 4, each drive member may include a central core 140 from which a set of flexible members 142 extend radially outward to define a circumference of the rotatable member. The flexible members 142 serve as the sliding mechanism 138. In one embodiment, each rotatable member is formed from an alternating sequence of first and second disks, with radii $r_1$ and $r_2$, respectively, where $r_1$ is less than $r_2$ (FIG. 4). The flexible members, in this embodiment, are defined by annular portions of the larger disks, such that the flexible members 142 have a radial length l, outward of the core, defined by $r_2-r_1$. For example, $r_1$ may be 10-20 mm. The radial length l of the flexible members may be at least 0.5 mm, such as up to 3 mm, or up to 2 mm, or up to 1 mm, and the width w of the flexible members, in the cross-process direction, may be at least 0.5 mm, such as up to 2 mm, or up to 1 mm, depending on the flexibility of the material used to form the flexible members and the weight of the media. The wheel 118, 120, 122 may have a width W of 20-40 mm in the cross-process direction. The disk-shaped flexible members 142 may be adhesively or otherwise connected together. The flexible members 142 are able to flex, when in contact with the sheet 12, to allow the sheet media to move in the cross-process direction towards the wall 116. Each rotatable member may include at least two, or at least three, or at least four flexible members 142, such as up to twenty, or up to ten flexible members, such as six or seven. While the illustrated flexible members 142 are annular, in other embodiments the flexible members 142 may be in the form of strips (FIG. 5). The strips 142 may be arranged in annular rings, or otherwise arranged around the central core 140.

The drive members 118, 120, 122 are rotated for applying a force to the sheets to translate the sheets in the process direction, thereby moving the print media 12 along the paper path, while the flexible tips 142 of the wheels allow the print media to slide under gravity towards the registration wall 116. Other, similarly configured, rotatable members, such as rotatable members 143, 144, positioned beneath the paper path (FIG. 4), may be idler wheels, i.e., not connected to a drive system. The idler wheels 143, 144 may be similarly configured to the drive wheels 118, 120, 122, with flexible members 142 and a core 140, which are axially mounted for rotation on a shaft 128, or other suitable bearing member. In the embodiment of FIG. 4, therefore, each rotation mechanism 100, 102 (and similarly 106, 108, not shown) includes two rotatable members, one being a drive wheel/roller and the other being an idler wheel/roller.

The portion of the paper path 18, in the region of the wall registration system, may gradually increase in angle from horizontal to achieve the angle θ, and then decrease in angle back to horizontal to allow takeaway by the transport downstream. For example, as illustrated in FIG. 3, sheets enter the wall registration system 70 via an input transport member 145 and, after registration, exit the wall registration system onto an output transport member 146. Transport members 145, 146 can be in the form of a conveyor belt, nip rollers, or the like. Each of the transport members may be angled to the cross-process direction at an angle of approximately θ at the end nearest the transport member 110 with the angle decreasing gradually or stepwise towards the end furthest from the transport member 110 to return the sheet to a horizontal alignment. Additionally, or alternatively, the transport member 110 has an angle which varies from one end to the other, with the desired angle θ being a maximum angle of the transport member occurring intermediate its ends 148, 149.

Figure 6:
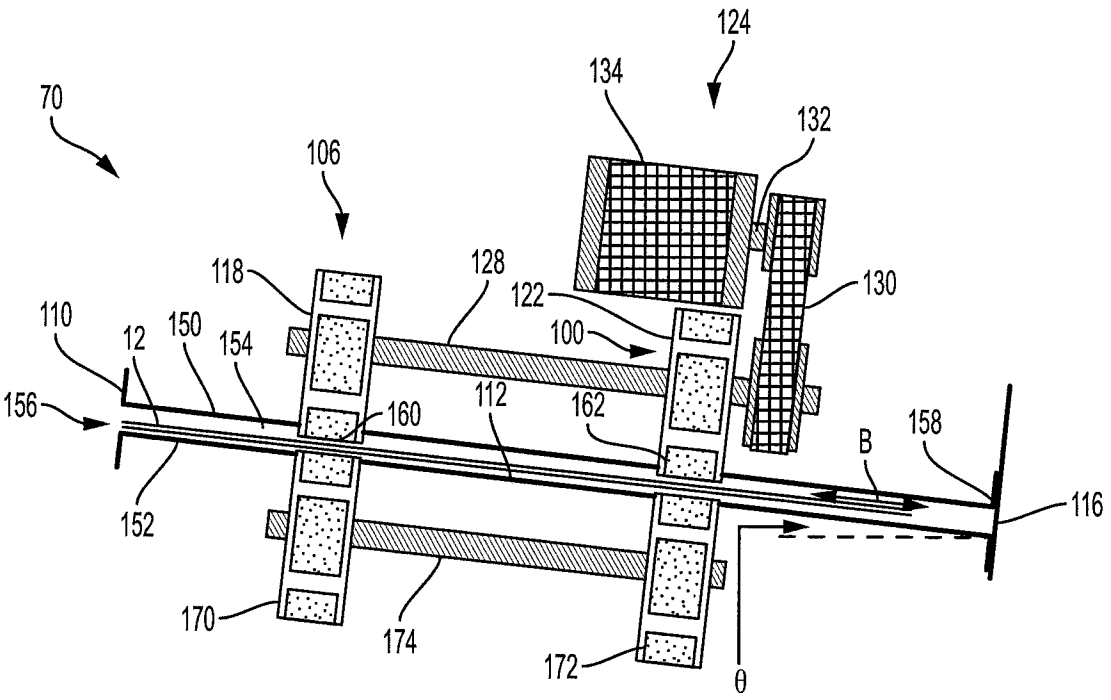
FIG. 6 is a side sectional view of a second embodiment of a gravity-assisted wall registration system.
Figure 7:
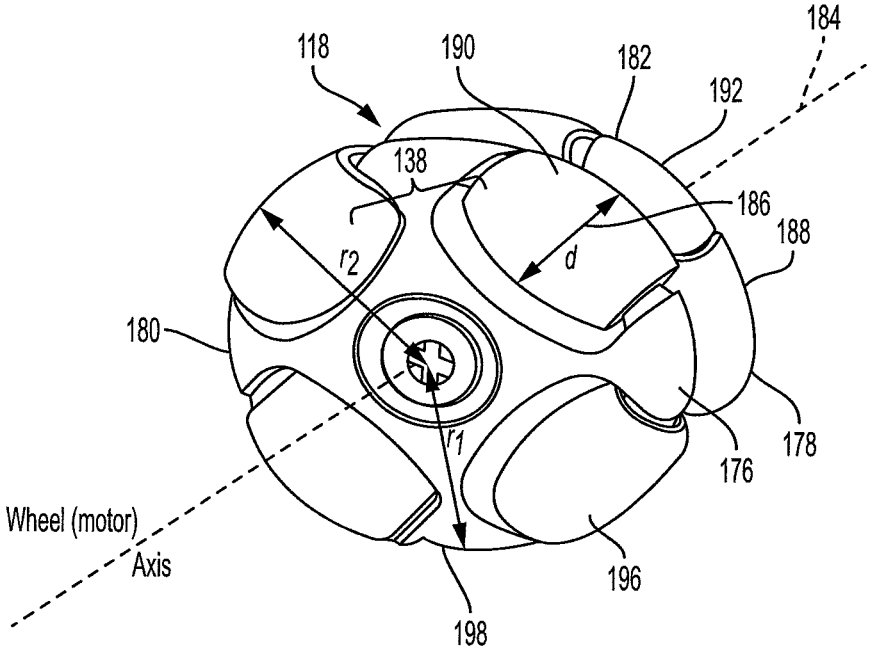
FIG. 7 is a perspective view of a wheel of the wall registration system of FIG. 6.
Figure 8:
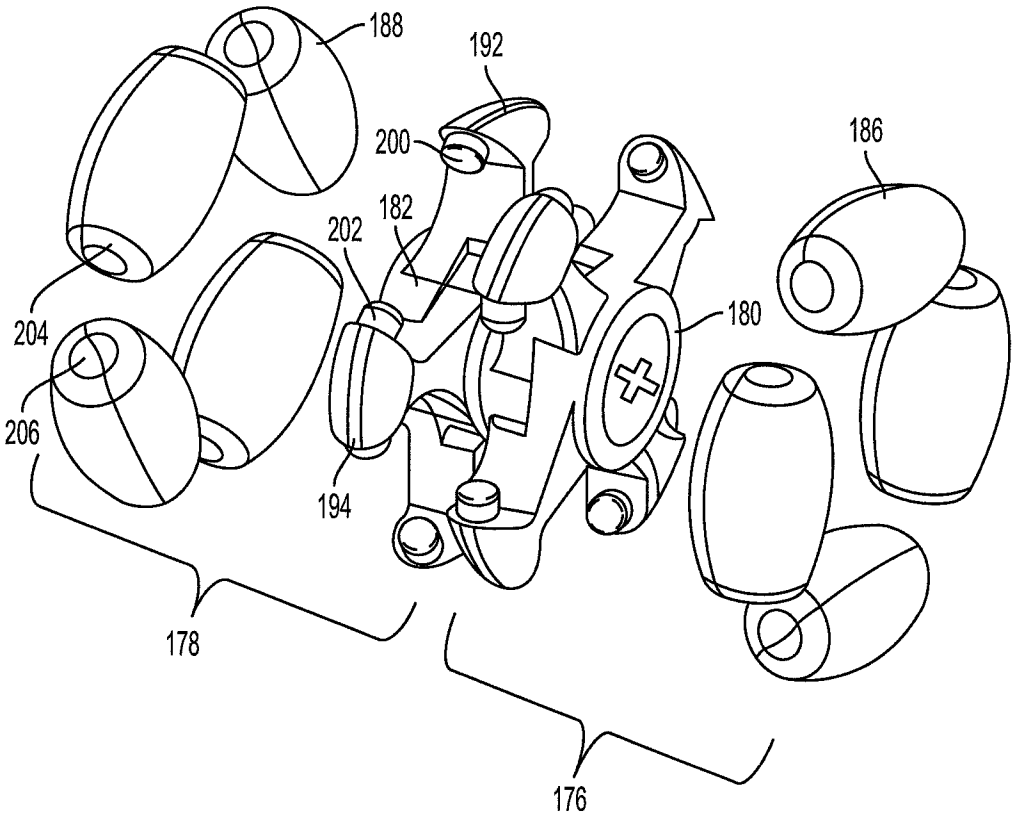
FIG. 8 is an exploded perspective view of the wheel of FIG. 7.

In a second embodiment, illustrated in FIGS. 6-8, the wall registration system 70 may be similarly configured to the embodiments of FIGS. 2-5, except as noted. Similar elements are accorded the same numerals. As for the embodiment of FIGS. 2-4, the sheet transport member 110 is set at an angle θ from horizontal in the cross-process direction. In this embodiment, the sheet transport member 110 is in the form of a baffle, defined by generally parallel upper and lower plates 150, 152, which define an air gap 154 between them, through which the sheet media 12 passes. An upper end 156 of the baffle 110 is open, while a lower end 158 is closed by a registration wall 116. In this embodiment, each of the rotation mechanisms 100, 102, 106, 108, etc. defines an omni-directional wheel nip 160, 162, through which the respective portion of the sheet 12 is able to travel in any direction as it passes through the nip, including in the process and cross-process directions A and B. Each nip 160, 162 is defined by a respective pair of rotatable members 118, 170 and 122, 172, respectively. In this embodiment, each of the rotation mechanisms 100, 102, 106, 108 thus includes two rotatable members. The rotatable members 118, 170, 122, 172 are in the form of omni-directional wheels, which are positioned above and below the sheet. The wheels 118, 170, 122, 172 extend through gaps in the baffle walls to contact the sheet 12. In each pair of omni-directional wheels, one of the wheels 118, 122 is a drive wheel, e.g., driven by a drive system 124, while the other 170, 172 is an idler wheel. As for the embodiment of FIGS. 2-4, two or more of the drive wheels, such as wheels 118, 122 may be mounted on a common shaft 128, which is driven by a common drive system 124. Similarly, the corresponding idler wheels 170, 172 may be mounted on a common shaft 174, which is free to rotate. The set of omni wheels 118, 170, 122, 172 provide translation of the sheet in the process direction but also allow the sheet to slide down and/or fall freely towards the wall 116. As with the embodiment of FIGS. 2-4, the sheet automatically registers against the hard edge created by the intersection of the surface 112 and the adjacent surface of the wall 116. An angle ∝ between the wall 116 and the surface 112 may be about 90°, such as 80-100° or 85-95° or 90°.

FIGS. 7 and 8 illustrate an example omni-directional wheel 118, suitable for use as a drive or idler rotatable member 118, 170, 122, 172 in the wall registration system 70 of FIG. 6. Each wheel 118 includes two (or more) substantially identical wheel sections 176, 178, each wheel section including a respective core member 180, 182. The core members are mounted collinearly on the same center axis 184 on the wheel axis for co-rotation (rotation together at the same rate). The wheel axis (e.g., of shaft 128) is generally perpendicular to the process direction A and parallel to the cross-process direction B. Mounted around the outer periphery of each core member is a set of rollers 186, 188, etc., which are free to rotate, with respect to the respective core. The rollers 186, 188 serve as the sliding mechanism 138 in this embodiment. Each roller 186, 188 may have a diameter d, perpendicular to its axis of rotation, which increases towards a midpoint of the roller. The rollers are staggered, as shown in FIG. 7, with the midpoint 190 of each roller being aligned with a respective spoke 192, 194, etc. of the other core member. In combination, the curved surfaces 196 of the rollers define arcs of a first circle, centered on the wheel axis, of radius $r_2$ while the intermediate curved surfaces 198 of the spokes 192, 194 define arcs of a second circle, centered on the wheel axis, of radius $r_1$, in a manner similar to the flexible members and core of the embodiment of FIGS. 2-4.

The omni-directional wheels provide drive (traction) normal to the rotation axis 128 while allowing sliding in the motor axis direction. Thus, they provide drive in the same way as regular wheel, but are able to slide freely side to side by positioning of the small rollers 186, 188 around the periphery of the wheel. Having a pair of wheel sections 176, 178, with the peripheral rollers 186, 188 staggered helps to ensure that a part of the wheel is always in contact with the sheet.

As illustrated in FIG. 8, in each of the wheel sections 176, 178, each roller 186, 188 may be supported, for free rotation about a respective rotation axis, on opposed bearings 200, 202. The bearings 200, 202 extend along the roller axis of rotation, and in a plane perpendicular to the wheel axis 184, from adjacent spokes 192, 194 of the same core member 180, 182. Each roller may include a corresponding pair of cavities 204, 206 to receive the respective bearings.

In the illustrated embodiment, each core member has four spokes 192, 194 and carries four rollers 186, 188, although fewer or more rollers and spokes are contemplated, such as from two to six. Additionally, while two wheel sections 176, 178 are shown on each wheel 118, fewer or more than two wheel sections 176, 178 in each wheel are contemplated, such as from one to four wheel sections.

Figure 9:
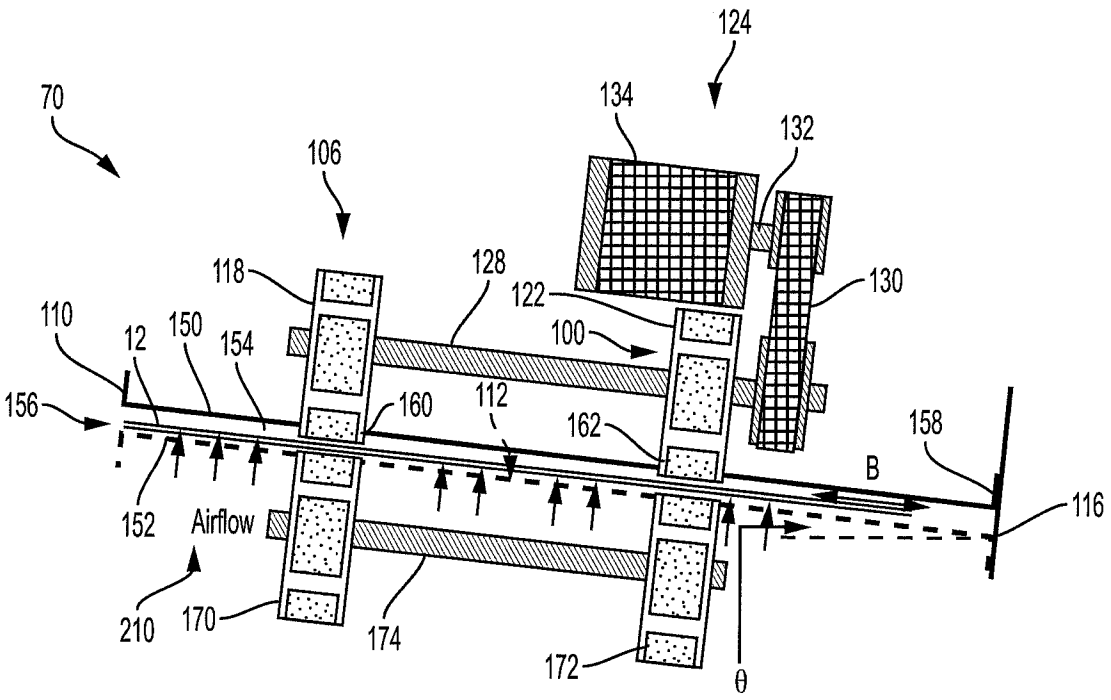
FIG. 9 is a side sectional view, in the process direction, of a third embodiment of a gravity-assisted wall registration system.
Figure 10:
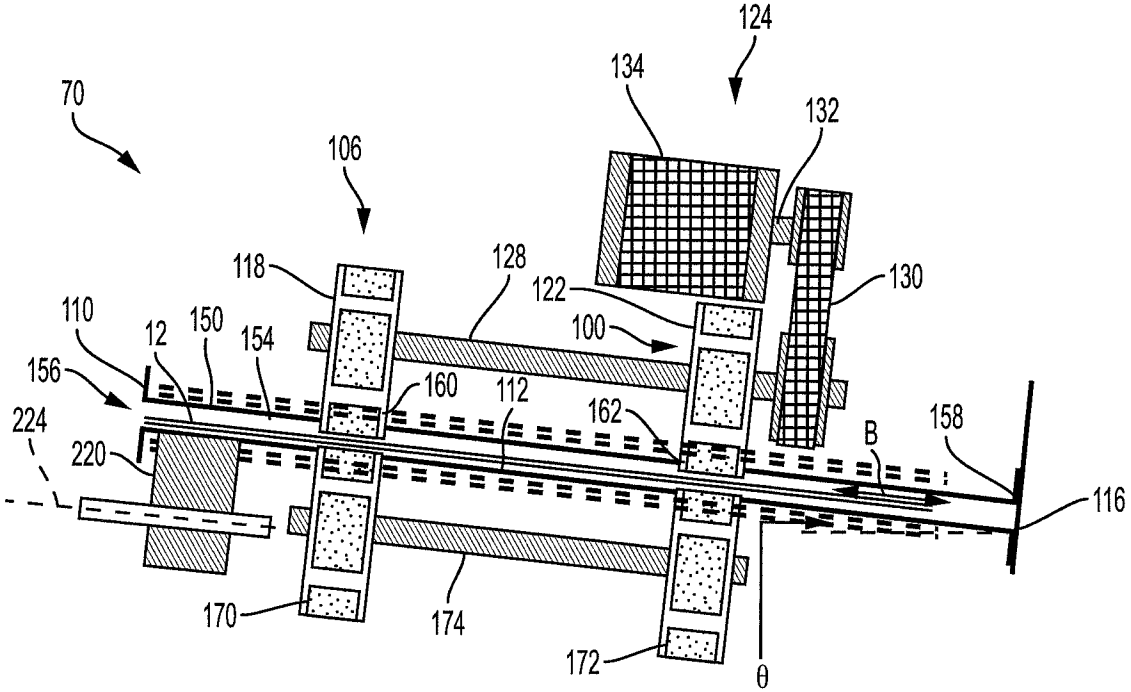
FIG. 10 is a side sectional view, in the process direction, of a fourth embodiment of a gravity-assisted wall registration system.
Figure 11:
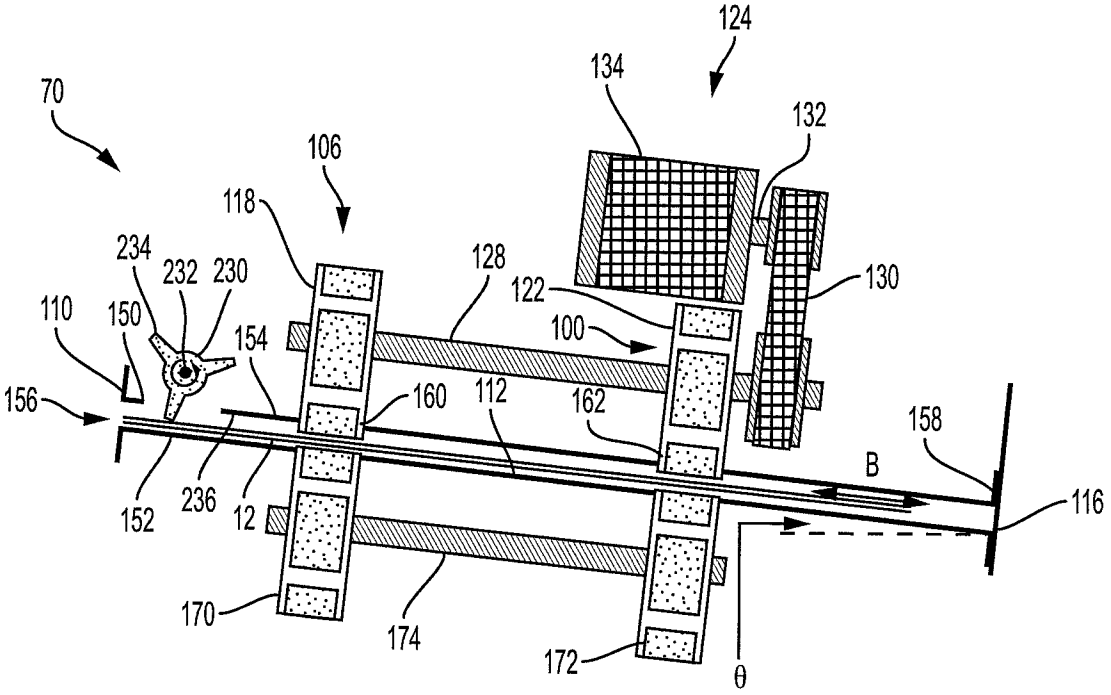
FIG. 11 is a side sectional view, in the process direction, of a fifth embodiment of a gravity-assisted wall registration system.

With reference to FIGS. 9-11, one or more registration assist mechanisms may be incorporated into any of the previously described embodiments to assist sheet registration against the registration wall 116.

In the embodiment of FIG. 9, the registration assist mechanism is in the form of an air bearing 210 below the sheet 12 is used to reduce friction forces between sheet and the baffle 110. For example, the lower baffle wall 152 is perforated along at least a portion of its length. A source (not shown) of pressurized gas, such as air, supplies gas under a slight partial pressure to the wall 152, which passes through the perforations into the air gap 154. The air bearing can also be directed toward the registration wall to aid in registration.

In the embodiment of FIG. 10, a vibrating baffle 110 is used to assist sheet slide. Vibration can be applied in an up and down direction (generally perpendicular to the plane of the baffle plate(s) 150, 152, or towards the registration wall. For example, a vibration mechanism 220, such as a rotating wheel with an acentric axis of rotation 224, is mounted adjacent one or both of the baffle plates 150, 152.

In the embodiment of FIG. 11, the registration assist mechanism is in the form of one or more flapper wheels 230, mounted above or below the paper path, configured to exert a force on the sheet towards the wall 116, in the cross-process direction. The flapper wheel 230 may be a flimsy rubber wheel that pushes the sheets softly towards the wall 116. The illustrated flapper wheel has an axis of rotation 232 which is generally aligned with the process direction and a plurality of spokes 234, radiating outwardly from the center of the flapper member to contact the sheet through a gap 236 in the baffle plate 150 (or 152). Two or more such flapper wheels may be spaced along the transport member 110 in the process direction.

As will be appreciated, combinations of the registration assist mechanisms 210, 220, 230 illustrated in FIGS. 9-11 may be employed in combination with the exemplary rotation mechanisms 100, 102, 106, 108.

The wall registration system 70 described in FIGS. 2-4 may include pairs of rollers, one roller above and one roller below the sheet, to provide nips similar to the nips 160, 162.

For the embodiment of FIG. 6, the wall registration system(s) may be arranged as illustrated in FIG. 3. In this embodiment, an angle θ of 10° is found to be sufficient to allow translation of 120 gsm sheet in the cross-process direction.

The angle θ may be tailored for the expected weight of the sheets. For a lower weight (gsm) paper (which is more difficult to slide down the transport) the angle could be greater than for a higher weight paper. Where the registration system 70 includes a registration assist mechanism 210, 220, 230, as illustrated in FIGS. 9-11, a lower angle θ may be sufficient. Alternatively, or additionally, the speed of the drive motor 134 may be adjustable to accommodate different paper weights. A higher motor speed may be suited to lower weight paper. A manual control may be provided on the drive motor 134 to allow selection of one of a set or a range of motor speeds.

The wall registration system 70 may be used as the sole registration system or may be used in combination with one or more other registration system(s) 72, positioned downstream and/or upstream of the registration system 70. A combination of the gravity-assisted pre-registration system 70 with a second registration system 72 which is generally only suited to use with smaller/lower weight sheets allows registration capabilities of an existing printer to be extended to larger and heavier sheets and/or when operating at faster speeds.

The wall registration system 70 does not need to employ complex steering algorithms which rely on feedback to correct misregistration. Rather, each sheet 12 is registered automatically, and often to different extents, as it passes through the registration system 70.

The gravity-assisted wall registration system 70 substantially reduces or eliminates the gross misalignment from the paper path that can occur with large, heavy media. This eliminates the need for large fishtailing maneuvers.

The registration system 70 is able to utilize the weight of heavier media to assist with the registration process.

The registration system 70 can be incorporated into the paper path of an existing printer design.

Figure 12:
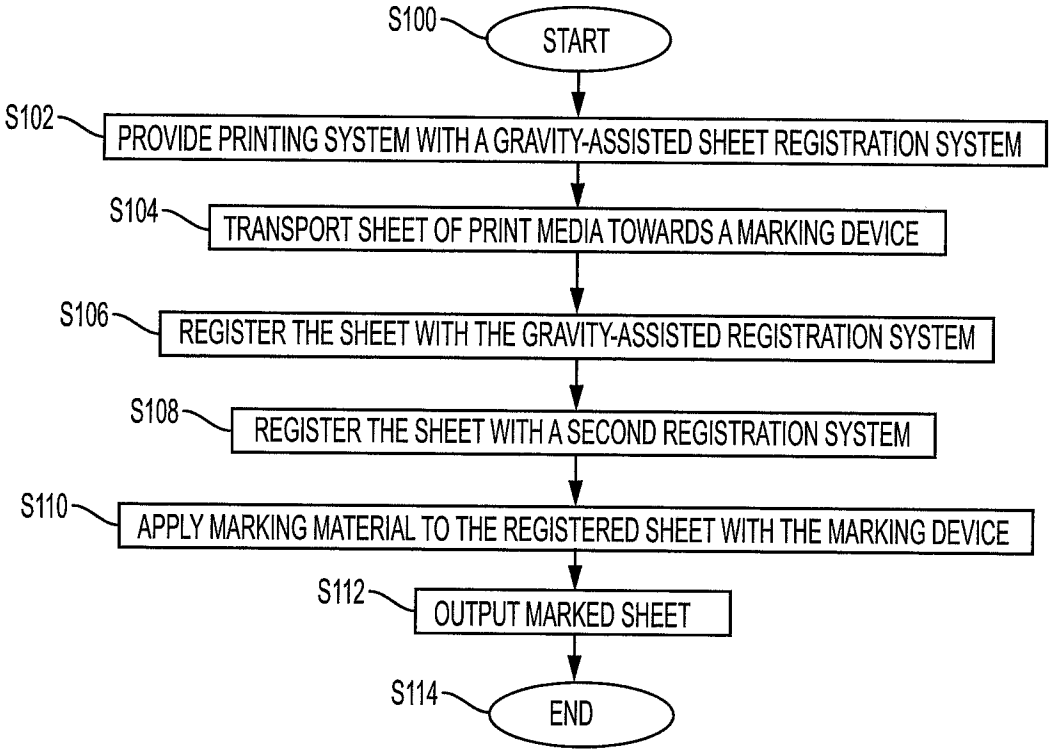
FIG. 12 illustrates a registration method.

With reference to FIG. 12, method of printing which can be performed with a printing system 10 in accordance with any of the embodiments described herein, is shown. The method begins at S100. At S102, a printing system is provided with the gravity-assisted wall registration system 70.

At S104, a sheet 12 of print media is transported in the process direction A, towards a marking device 22, on a print media path 18, by a sheet transport system 14.

At S106, the sheet of print media is registered with the gravity-assisted wall registration system 70, as described herein, to reduce at least one of skew and lateral shift.

Optionally, at S108, the sheet of print media is registered with second registration system 72, as described herein, to reduce at least one of skew and lateral shift.

At S110, a marking material is applied to the sheet, which has been registered with registration system 70 and optionally registration system 72, with the marking device 22.

At S112, the marked sheet is output. As will be appreciated, the marked sheet may undergo further marking, registering with a wall registration system 70, and/or other processing prior to being output from the printer.

The method ends at S114.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A gravity-assisted wall registration system comprising:

a transport member including a surface on which an associated sheet is translated in a process direction, the surface defining an angle with respect to horizontal in a cross-process direction of at least 1 degree;

a registration wall adjacent a lower end of the surface which defines a registration edge for registering the sheet;

a drive mechanism;

at least one rotation mechanism, driven by the drive mechanism, for translating the sheet in the process direction, each rotation mechanism including at least one drive member, positioned above the sheet, with an axis of rotation parallel to the surface in the cross-process direction, each drive member including a sliding mechanism, at a periphery of the drive member, enabling the sheet to slide, under gravity, on the surface, toward the registration wall into an alignment position, in contact with the registration wall; and a registration assist mechanism which applies a force to the sheet to assist the sheet in sliding towards the wall.

2. A gravity-assisted wall registration system comprising:

a transport member including a surface on which an associated sheet is translated in a process direction, the surface defining an angle with respect to horizontal in a cross-process direction of at least 1 degree;

a registration wall adjacent a lower end of the surface which defines a registration edge for registering the sheet;

a drive mechanism; and at least one rotation mechanism, driven by the drive mechanism, for translating the sheet in the process direction, each rotation mechanism including at least one drive member with an axis of rotation parallel to the surface in the cross-process direction, each drive member including a sliding mechanism, at a periphery of the drive member, enabling the sheet to slide, under gravity, on the surface, toward the registration wall into an alignment position, in contact with the registration wall, wherein the sliding members include flexible members which extend radially outward from the at least one drive member, and wherein each flexible member has a width of up to 2 mm, in the cross-process direction and/or wherein the flexible members are defined by annular portions of first disks having a first radius, which are spaced, in the cross-process direction, by second disks of a smaller radius than the first disks.

3. The system of claim 2, wherein each drive member includes at least three flexible members.

4. The system of claim 1, wherein the sliding members include a plurality of rollers, carried by a core of the drive members, the rollers having an axis of rotation which is perpendicular to the axis of rotation of the drive member.

5. The system of claim 4, wherein each drive member includes a plurality of core members with a collinear axis of rotation, each of the core members carrying a plurality of the rollers.

6. The system of claim 1, wherein the angle is at least 5 degrees.

7. The system of claim 1, wherein the angle is no more than 45 degrees.

8. The system of claim 1, wherein the at least one rotation mechanism includes at least two rotation mechanisms which are spaced in the cross-process direction.

9. The system of claim 8, wherein the at least two rotation mechanisms which are spaced in the cross-process direction are driven by the same drive mechanism.

10. The system of claim 1, wherein the at least one rotation mechanism includes at least two rotation mechanisms which are spaced in the process direction.

11. The system of claim 10, wherein the at least two rotation mechanisms which are spaced in the process direction are driven by the same drive mechanism.

12. The system of claim 1, wherein the at least one rotation mechanism includes at least six rotation mechanisms which are spaced in at least one of the process direction and the cross-process direction.

13. The system of claim 2, further comprising a registration assist mechanism which applies a force to the sheet to assist the sheet in sliding towards the wall.

14. A printing system comprising a sheet transport system including the gravity-assisted registration system of claim 1.

15. A printing system comprising a sheet transport system, the sheet transport system comprising:

a first registration system, the first registration system being a gravity-assisted wall registration system, comprising:

a transport member including a surface on which an associated sheet is translated in a process direction, the surface defining an angle with respect to horizontal in a cross-process direction of at least 1 degree;

a registration wall adjacent a lower end of the surface which defines a registration edge for registering the sheet;

a drive mechanism; and at least one rotation mechanism, driven by the drive mechanism, for translating the sheet in the process direction, each rotation mechanism including at least one drive member with an axis of rotation parallel to the surface in the cross-process direction, each drive member including a sliding mechanism, at a periphery of the drive member, enabling the sheet to slide, under gravity, on the surface, toward the registration wall into an alignment position, in contact with the registration wall; and a second registration system, which receives sheets registered by the gravity-assisted wall registration system.

16. The printing system of claim 15, further comprising a sensor, downstream of the gravity-assisted registration system, for detecting at least one of a lateral shift and a skew of sheets being transported from the gravity-assisted registration system to the second registration system.

17. A printing system comprising:

a marking device which applies a marking material to associated sheets of print media;

a sheet transport system which transports the sheets in a process direction to the marking device, the sheet transport system including a gravity-assisted registration system comprising:

a transport member including a surface on which the sheets are translated in the process direction, the surface defining an angle with respect to horizontal in a cross-process direction of at least 1 degree;

a registration wall adjacent a lower end of the surface which defines a registration edge for registering the sheets;

a drive mechanism; and at least one rotation mechanism, each rotation mechanism including:

at least one first rotatable member, driven by the drive mechanism, the first rotatable member being positioned above the sheet, with an axis of rotation parallel to the surface in the cross-process direction, which translates the sheets in the process direction, each drive member including a sliding mechanism, at a periphery of the drive member, enabling each of the sheets to slide, under gravity, on the surface, toward the registration wall into an alignment position, in contact with the registration wall, and at least one second rotatable member, positioned below the sheet to provide a nip with one of the at least one first rotatable members, and having an axis of rotation parallel to the surface in the cross-process direction.

18. A method of printing comprising:

transporting a sheet of print media in a process direction on a print media path;

registering the sheet of print media with a gravity-assisted registration system to reduce at least one of skew and lateral shift; and applying a marking material to the sheet with a marking device positioned on the paper path, upstream or downstream of the gravity-assisted registration system;

wherein the gravity-assisted registration system comprises:

a transport member including a surface on which the sheet is translated in the process direction, the surface defining an angle with respect to horizontal in a cross-process direction, of at least 1 degree;

a registration wall adjacent a lower end of the surface which defines a registration edge for registering the sheet;

a drive mechanism; and at least one rotation mechanism, driven by the drive mechanism, each of the at least one driven rotation mechanism including at least one drive member, positioned above the paper path, with an axis of rotation parallel to the surface in the cross-process direction, which translates the sheet in the process direction, each drive member including a sliding mechanism, at a periphery of the drive member, enabling the sheet to slide, under gravity, on the surface, toward the registration wall into an alignment position, in contact with the registration wall.

19. The system of claim 1, wherein the registration assist mechanism which applies a force to the sheet to assist the sheet in sliding towards the wall comprises at least one of:

an air bearing, positioned below the sheet, to reduce friction between the surface and the sheet, the air bearing including perforations in a baffle which defines the surface;

a vibrating baffle, which defines the surface; and one or more flapper wheels, mounted above or below the paper path, configured to exert a force on the sheet towards the wall, in the cross-process direction.

* * * * *